United States Patent [19]

Garret

[11] Patent Number: 5,071,121

[45] Date of Patent: Dec. 10, 1991

[54] GAME SCORE COMPUTING DEVICE

[76] Inventor: Michael J. Garret, 834 Pacific Drive, Delta, B.C., Canada, V4M 2K3

[21] Appl. No.: 566,660

[22] Filed: Aug. 13, 1990

[51] Int. Cl.[5] ..... A63F 9/24; A63D 15/20

[52] U.S. Cl. ..... 273/14; 273/2; 273/DIG. 26; 273/148 R

[58] Field of Search ..... 273/2, 14, 148 R, DIG. 26

[56] References Cited

U.S. PATENT DOCUMENTS

| | | | |
|---|---|---|---|
| 4,220,330 | 9/1980 | Montgomery | 273/DIG. 26 |
| 4,524,968 | 6/1985 | Dölp | 273/2 |
| 4,840,376 | 6/1989 | Garret | 273/14 |

FOREIGN PATENT DOCUMENTS

| | | | |
|---|---|---|---|
| 2592808 | 7/1987 | France | 273/2 |
| 8101573 | 10/1982 | Netherlands | 273/2 |
| 2186491 | 8/1987 | United Kingdom | 273/DIG. 26 |

*Primary Examiner*—Edward M. Coven
*Assistant Examiner*—Harrison: Jessica J.
*Attorney, Agent, or Firm*—Townsend and Townsend

[57] ABSTRACT

A game score computing device has first manually actuatable input switches for inputting data corresponding to game scores of game players, second manually actuatable input switches for inputting time data corresponding to the durations of the playing times of each of the game players and a data processor responsive to the game score data and the timing data for determining which of the game players is a winning player. A display responsive to the data processor provides a visual display identifying the winning player.

3 Claims, 7 Drawing Sheets

GAME SCORE COMPUTING DEVICE

FIELD OF THE INVENTION

The present invention relates to game score computing devices and, more particularly, to devices which players of a game can operate to enter their scores for computation of a winner.

BACKGROUND OF THE INVENTION

Conventional game score-boards usually comprise a blackboard or the like onto which the scores of game players can be written, or some kind of mechanical device having markers or the like which can be adjusted in position to indicate the scores of the players.

Normally, such conventional score-boards can be used to display the results of only a single game and do not enable the winner of such a game to be automatically determined from the players scores.

In my U.S. Pat. No. 4,840,376, issued June 20, 1989, I have disclosed a poker type pool game having a scoreboard having two sets of switches, each switch being associated with a respective card and the two sets being respectively associated with two players. By actuating the switches, the players record that they have pocketed correspondingly identified balls on a pool table. Actuation of a further switch then causes the scoreboard to compute which of the two players is the winner. This prior scoreboard can, therefore, only be operated in one mode, corresponding to a particular poker-type pool game.

BRIEF SUMMARY OF THE INVENTION

It is accordingly an object of the present invention to provide a novel and advantageous game score computing device which can be used to compute and display the winner of more than one game.

According to the present invention, there is provided a game score computing device which comprises first manually actuatable switch input means for inputting data corresponding to game scores of game players, timing means for timing the duration of play by each of the game players, and second manually actuatable input switch means for initiating and ending timing operations of the timing means at the beginning and end of the plays of the game players. Data processing means responsive to the game score and the timing operation of the timing means are provided for determining which of the game players is a winning player, and display means responsive to the data processing means provide a visual display identifying the winning player.

A preferred embodiment of the invention comprises third manually actuatable input switch means for inputting first, second and third selection signals. In this case, the data processing means comprise means responsive to the first game selection signal for determining the winning player from the game score data only; means responsive to the second game selection signal for determining the winning player from the timing operations only; and means responsive to the third game selection signal for determining the winning player from both the game score data and the timing operations.

BRIEF DESCRIPTION OF THE DRAWINGS

The invention will be more readily understood from the following description of a preferred embodiment thereof given by way of example, with reference to the accompanying drawings, in which.

THE PREFERRED EMBODIMENT

Figure 1:
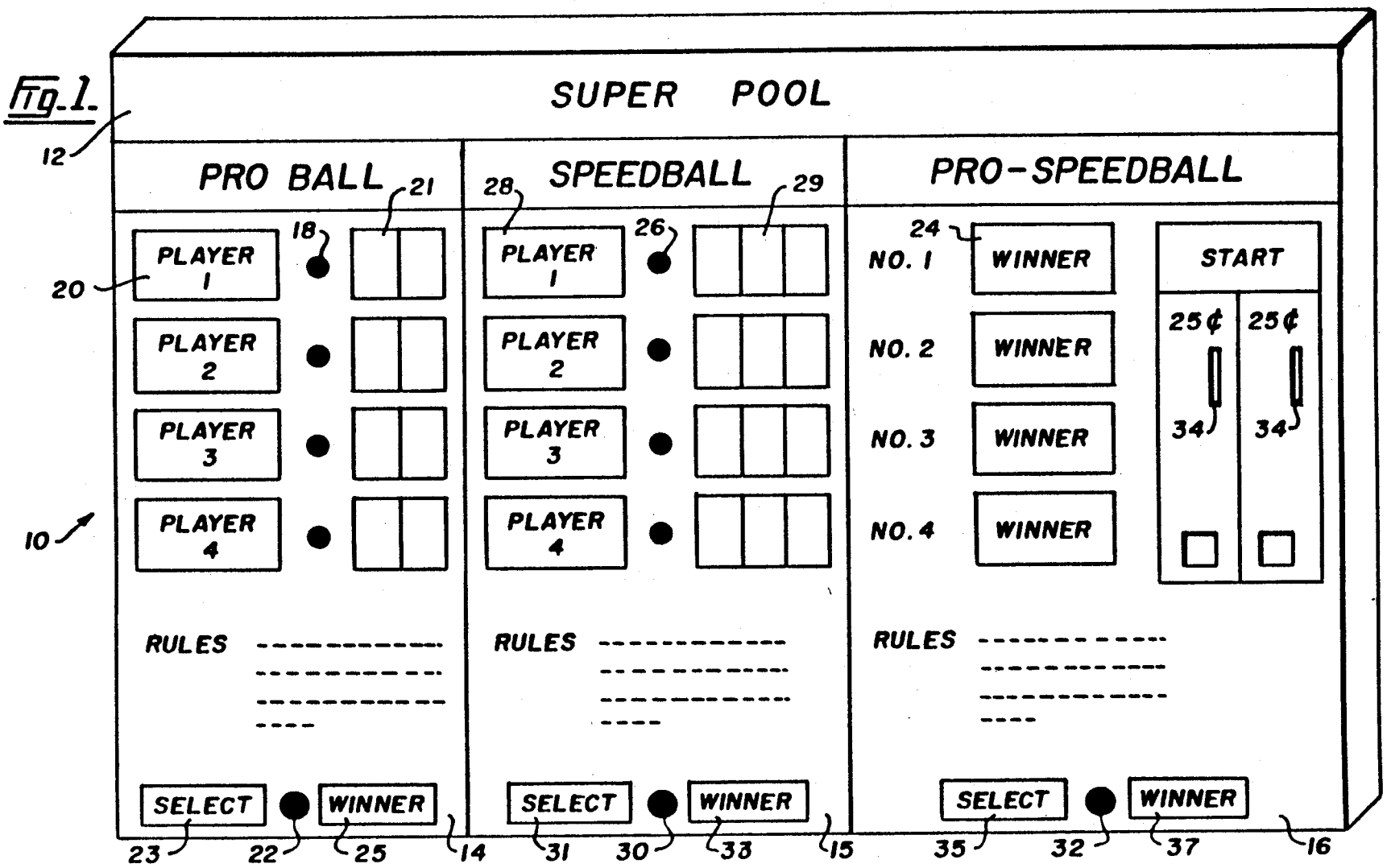
FIG. 1 shows a view in perspective of a game score computing device embodying the present invention.

The game score computing device illustrated in FIG. 1 and indicated generally by reference numeral 10 is intended in particular for use with a standard pool table (not shown) and comprises a housing 12 having a front face, the major portion of which is divided into three fields 14, 15 and 16.

The field 14 is used for recording the score of a first game, which is identified as PRO BALL. For that purpose, four press-button switches 18 are provided in the field 14 and are respectively associated with player identification windows 20 displaying designations identifying four different players, i.e. PLAYER 1; PLAYER 2; . . . etc. Each of the push-button switches 18 is also associated with a respective score display window 21. By pressing the switches 18, the scores of the players can be displayed in the windows 21.

The field 14 is also provided with a further push-button switch 22 for inputting a first game control signal, in response to which the device automatically computes the winner of the first game, i.e. the player having the lowest score displayed at the respective window 21, and produces an indication of the winner. More particularly, the field 14 has, on opposite sides of the switch 22, windows 23 and 25 which can illuminated to display the words SELECT and WINNER, respectively. When the scoreboard is initially switched on, the SELECT window 23 is illuminated intermittently, i.e. caused to flash repeatedly. When the switch 22 is depressed to initiate the game, both windows 23 and 25 are illuminated continuously. When, at the end of the game, the switch 22 is again pressed, then the SELECT window 23 is no longer illuminated, but the WINNER window 25 and the player identification window 20 of the winning player are caused to flash repeatedly.

The field 15, which is for recording timing operations of a game called SPEEDBALL, has four press button switches 26, each associated with a respective player identification window 28 for displaying a player identification and a respective timing display window 29. By pushing each of the switches 26 in turn, at the beginning and end of play by each of the players, the duration or length of time during which the players are playing the game can be input into the device and displayed in the windows 29.

The field 15 also has a game control switch 30, which can be depressed to initiate the game SPEEDBALL and, at the end of the game, to input third game control signals to compute the winner for the four players whose lengths of play are displayed in the windows 29, for example the player having the shortest length of play. The winner is again displayed.

More particularly, SELECT and WINNER windows 31 and 33, are provided at opposite sides of the switch 30. The SELECT window 31 flashes during the idle mode. SELECT window 31 and WINNER window 33 are both illuminated when the switch 30 is actuated to initiate the SPEEDBALL game. When the switch 30 is again actuated at the end of the game, the SELECT window 31 is switched off and the WINNER window 33 and the player identification window 28 of the winning player both flash.

The field 16, used for a game called PRO-SPEEDBALL, has a third game control switch 32 which can be manually actuated to input third game control signals and thereby to cause the computer to determine the winner of a third game, which is, in fact, a combination of the games associated with fields 14 and 15, and to illuminate a corresponding one of four WINNER identification windows 24.

More particularly, in response to actuation of the switch 32, the device determines a winner from a combination of the game score data displayed in the windows 21 and the timing operations displayed in the windows 29, and identifies this winner in the respective window 24.

SELECT and WINNER windows 35 and 37 are provided at opposite sides of the switch 32, and the SELECT window 35 flashes during the idle mode. When the switch 32 is depressed to initiate the PRO-SPEEDBALL game, the SELECT and WINNER windows 35 and 37 are both illuminated. When the switch 32 is depressed at the end of the game, the SELECT window 35 is switched off and the WINNER window 37, and the WINNER identification window 24 of the winning player, both flash.

The field 16 also has coin slots 34 for receiving coins to enable operation of the device.

Figure 2:
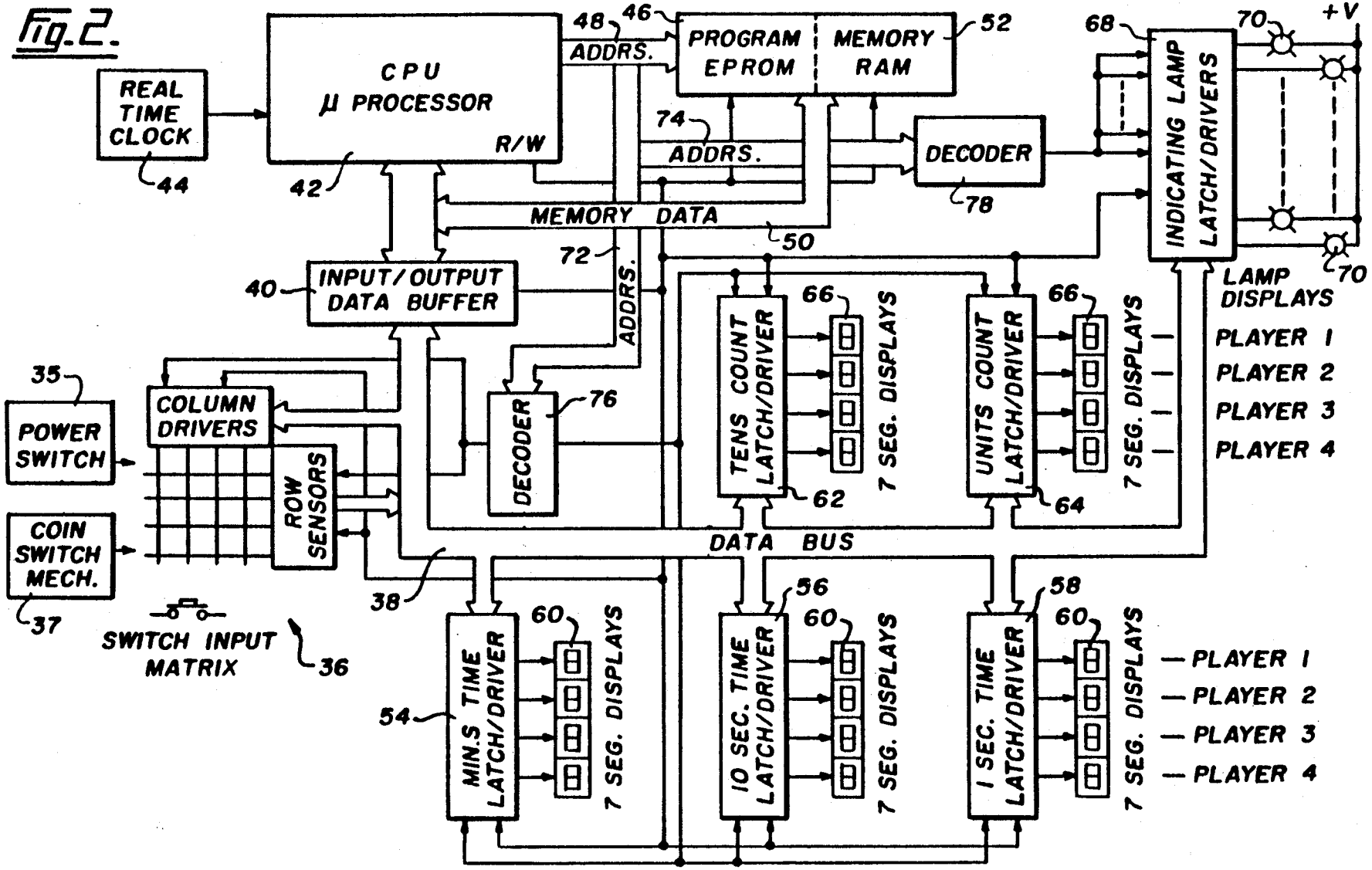
FIG. 2 shows a block diagram of the electronic circuitry of the game score computing device of FIG. 1.
Figure 3:
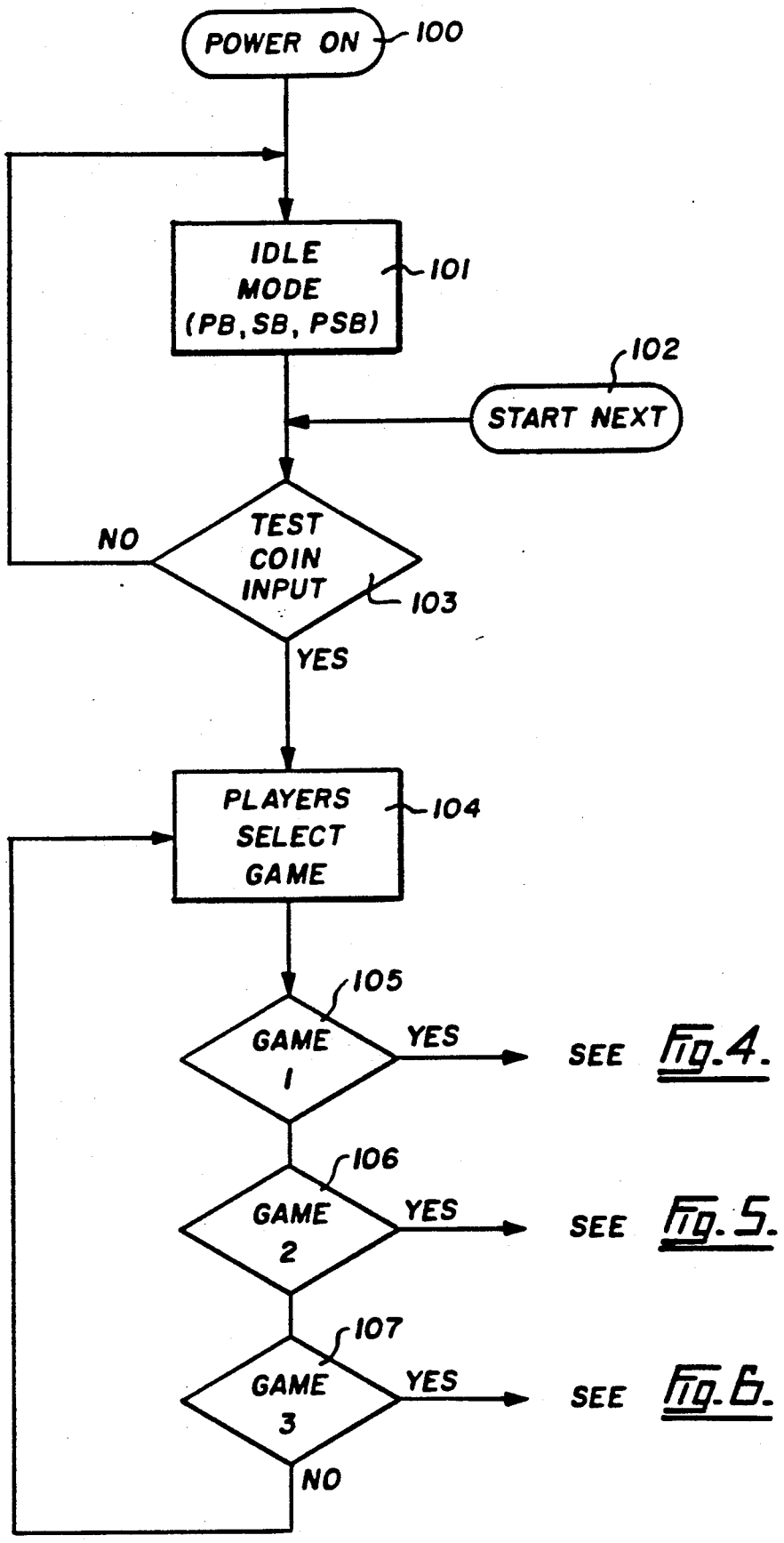
FIGS. 3 through 7 show a flow chart illustrating that the operation of the game score computing device of FIGS. 1 and 2.
Figures 4, 7:
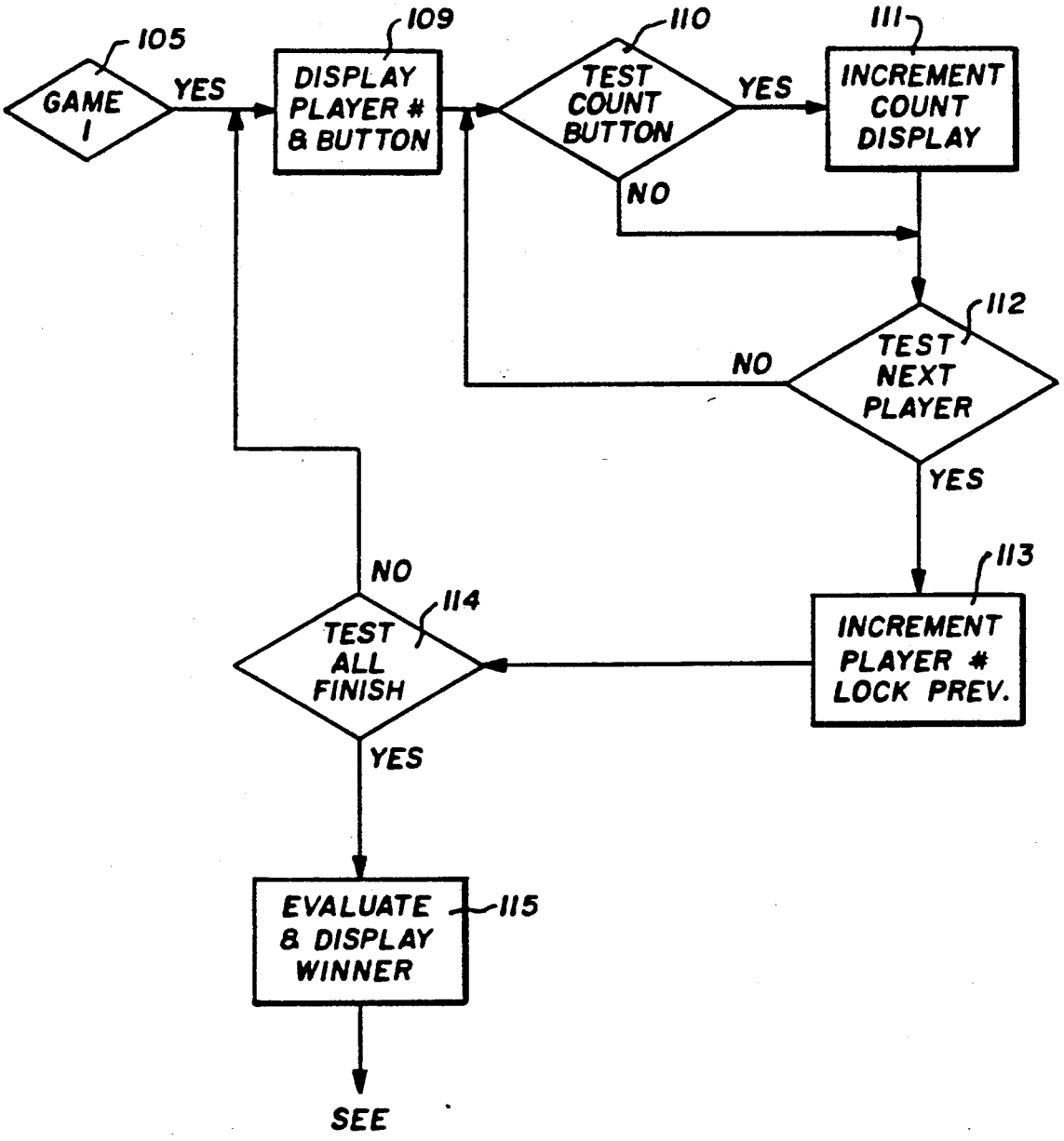
Figures 5, 7:
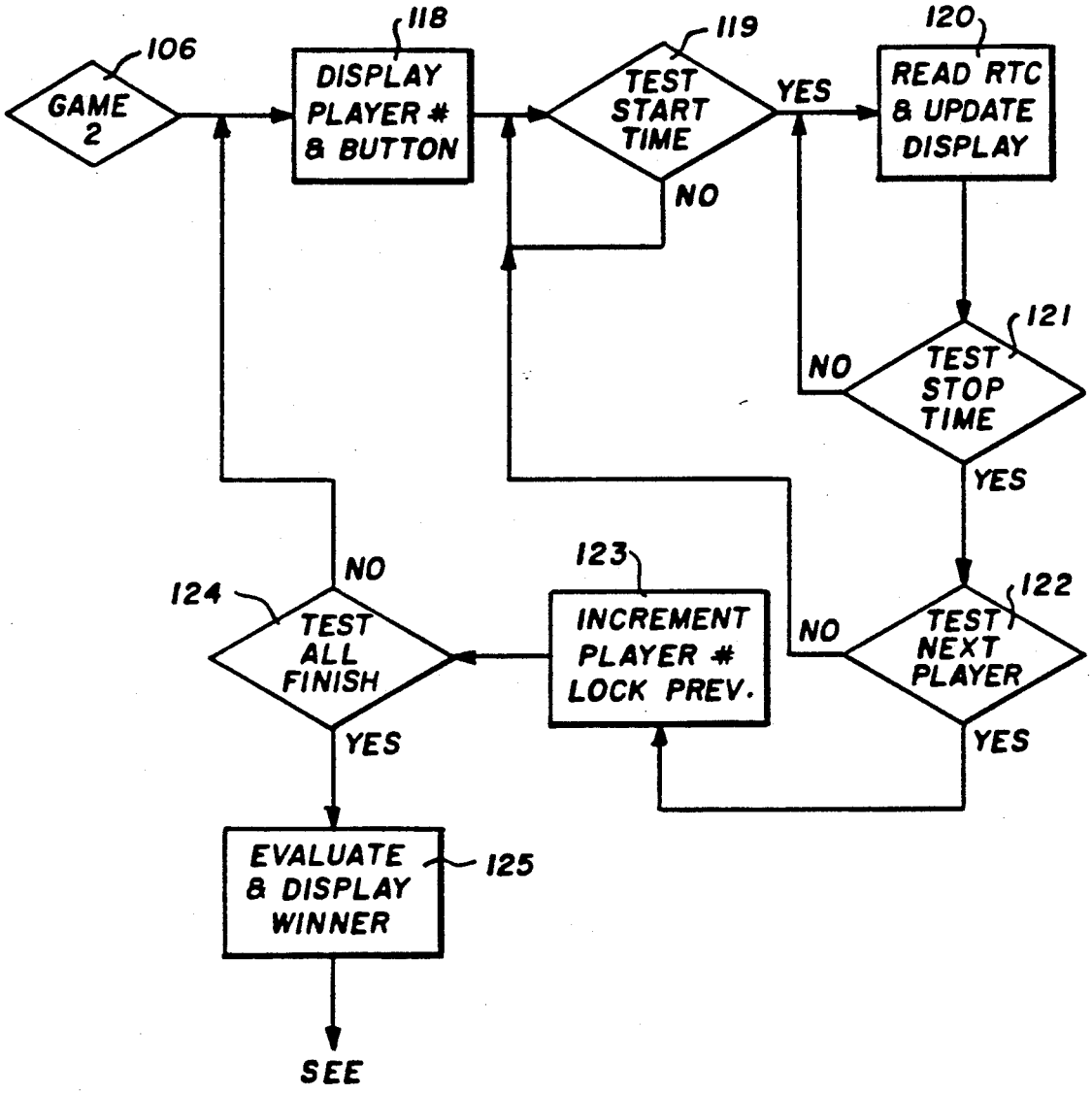
Figures 6, 7:
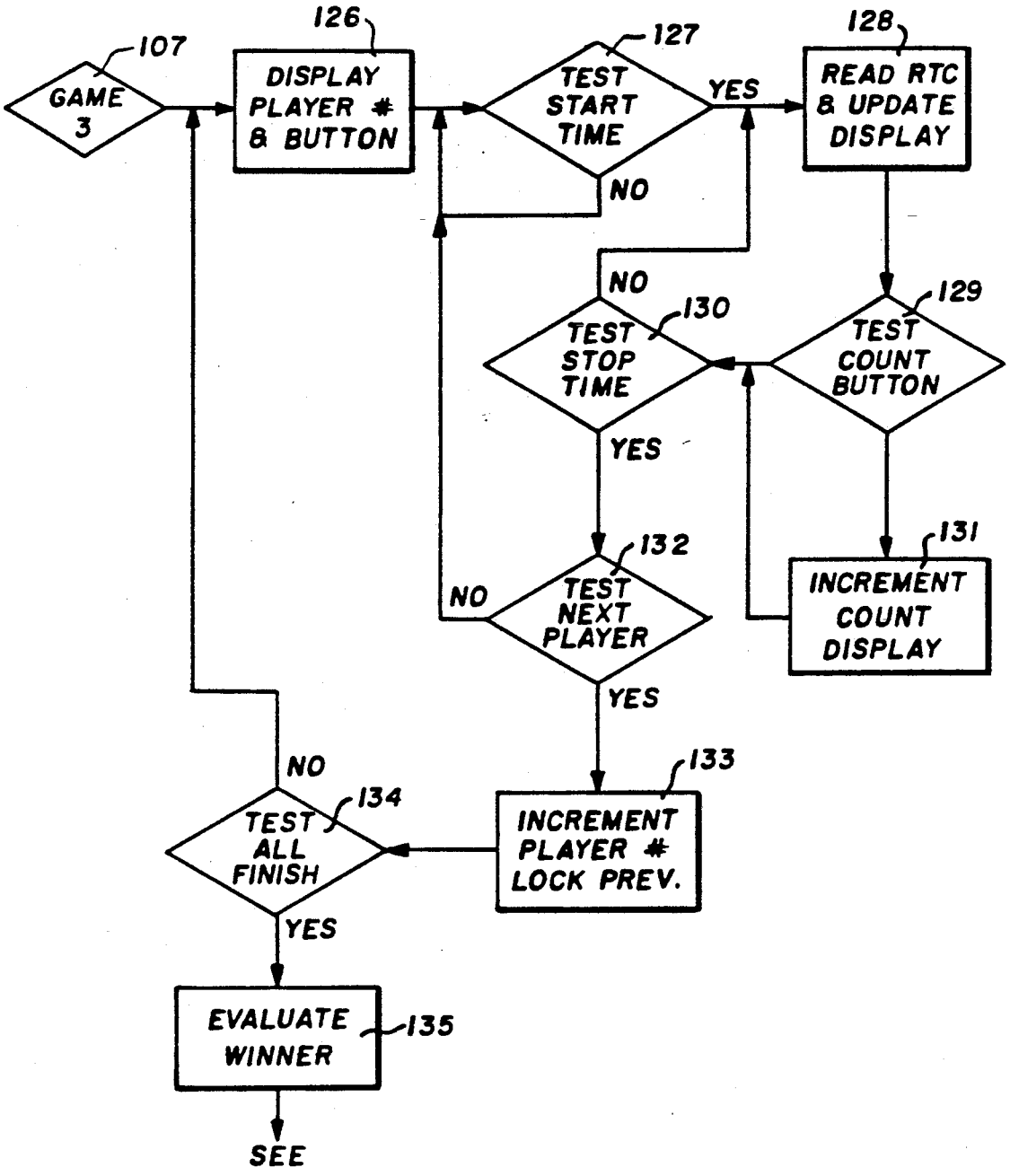
Figure 7:
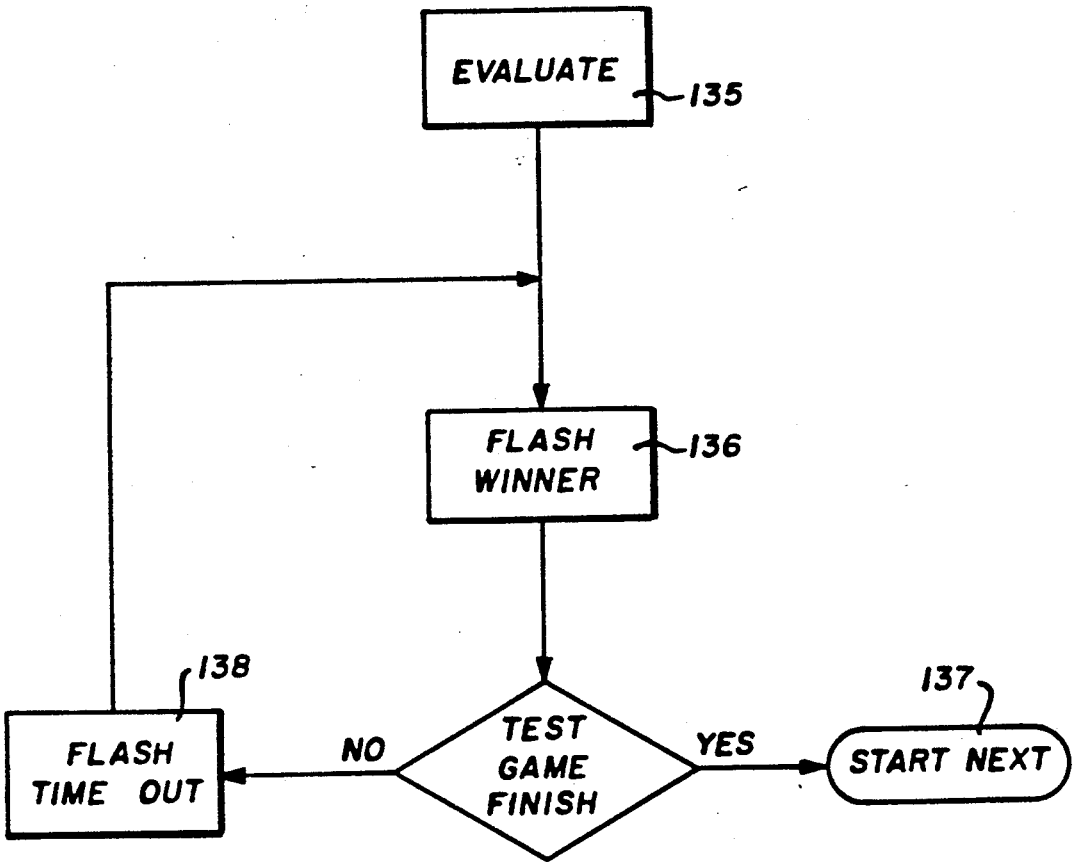

The switches 18, 22, 26, 30 and 32 form parts of a switch input matrix which is indicated generally by reference numeral 36 in FIG. 2.

A power switch 35 controls the supply of power from a current supply network (not shown) to the circuit, and a coin switch mechanism 37, when actuated by the insertion of coins through the coin slots 34, enables the circuit to operate in response to manual actuation of the switches. The power switch 35 and the coin switch mechanism 37 are both connected to the switch matrix 36. The coin switch mechanism 37 may be omitted when the scoreboard is intended for home use.

By means of a data bus 38, the data input into the device through the switch input matrix 36 is transferred, through an input/output data buffer 40, into a microprocessor CPU 42.

A real time clock 44 outputs to the microprocessor CPU 42, and a program for controlling the operation of the device is stored in a program EPROM 46, connected to the microprocessor 42 through an address bus 48 and a memory data bus 50. The memory data bus 50 also transfers data to and from a RAM 52.

The data bus 38 is also connected to three latch/-driver units 54, 56 and 58, each of which outputs to a respective group of four 7-segment displays 60, respectively associated with four players of the game, the displays 60 serving to display the lengths of play in the windows 29 of field 15, shown in FIG. 1. The latch/-driver units 54, 56 and 58 are respectively associated with the minutes, the ten second and the one second displays of the windows 29.

The data bus 38 is further connected to two latch/-driver units 62 and 64, which serve respectively, to control the tens count and the unit count of score displays in the windows 21 of field 14. The latch/driver units 62 and 64 are each provided with a group of four 7-segment displays 66, respectively associated with the four players, the displays 66 being respective associated with the four windows 21 of FIG. 1.

Data bus 38 is also connected to a latch/driver unit 68, controlling display lamps 70 in the winner windows 24 of field 16.

Address buses 72 and 74 connect the microprocessor 42 to decoders 76 and 78 respectively. The decoder 76 is connected to the switch input matrix 36, the latch/-driver units 54, 56, 58, 62 and 64 and the latch/driver unit 68, which the decoder 78 connects the address bus 74 to the latter.

The operation of the above-described device will now be described with reference to the flow chart of FIGS. 3 to 7.

In an initial step 100, the power switch (not shown) is closed to connect the circuit of FIG. 2 to a suitable power source (not shown), and the circuit then enters an idle mode at step 101. On insertion of a coin through one of the coin slots 34, at step 102, the device senses the coin input at step 103. At step 104, the players then select a game, by depressing one of the three game selection switches 22, 30 and 32. In the next three steps 105, 106 and 107, the circuit determines which of these switches has been depressed.

If switch 22 has been depressed, to enable the PRO BALL game, then the initial player identification window 20, i.e. "PLAYER 1", and its associated push-button switch 18, are illuminated at step 109. The push-button switch 18 associated with the first player is then tested at step 110 and, if depressed, the count display 21 controlled by the latch/drivers 62 and 64 is incremented at step 111.

The push-button switch 18 associated with the next player, i.e. player 2, is then tested at step 112 and, if this push-button is depressed, then in step 113 the score entered into the display 21 of PLAYER 1 is locked and the display in window 20 of PLAYER 1 is switched off, whereas that of PLAYER 2 is illuminated.

This procedure is repeated until, at step 114, the scores of all four players have been entered, whereupon these scores are evaluated in response to actuation of switch 22, and the winner, i.e. the player with the lowest score, is indicated by flashing of the corresponding player identification window 20 and winner window 25, as described above, at step 115.

If, at step 106, it is determined that the game SPEEDBALL has been selected, then the relevant player window 28 and the associated button 26 are illuminated in step 118 and, at step 119, closure of the respective input switch 26 is detected to initiate timing of the duration, or length of time, of the play of the first player. The corresponding display 29 is updated at step 120 and, at step 121, the termination of this timing operation is detected and employed to initiate the next timing operation, by the next player at step 122, on the next actuation of the switch 26 associated with PLAYER 2. The time display of the first player in the respective window 29 is locked at step 123, and the corresponding window 28 of PLAYER 1 is switched off, and that of PLAYER 2 is switched on.

The process is repeated for all four of the players and, at step 124, completion of the timing operations of the four players is detected and employed to effect an evaluation of the durations of play of each of the players and a consequential selection of a winner for display by flashing of the corresponding player identification window 28 winner window 33 in step 125.

If, at step 107, it is determined that game selection switch 32 has been actuated, then the windows 20 and 28 of PLAYER 1, and the respective switches 18 and 26, are enabled at step 126, and the timing of the duration of the play of the first player is started at step 127. The time display in window 29 of that player is updated at step 128. Meanwhile, the corresponding switch 18 is actuated to input the player's score in window 21. If it is then determined, in step 129, that the respective switch 26 has again been actuated, then timing of the duration of that player is terminated at step 130, and the count display in window 21 and the timing count in corresponding window 29, associated with that player, and incremented at step 131. At step 132, selection of the next player is determined by actuation of switch 26 associated with PLAYER 2, whereupon at step 133 the window 20 and 28 and their display windows 21 and 29 for that player are illuminated, and so on.

At step 134, it is determined by actuation of switch 32 that all of the players have completed their plays. The results of these plays are then evaluated by assigning a numerical value to each of the timings displayed in the windows 29 and combining these numerical values with the game scores displayed in windows 21 at step 135.

At step 136, the WINNER identification window 24 of the thus-determined winning player in field 16 is caused to flash for a predetermined period of time.

If a new game is not initiated, at step 137, within this period of time, then at step 138 the flashing of the winner is terminated and the score board returns to the idle mode of step 101.

I claim:

1. A game score computing device, comprising:

at least two first manually actuatable input switch means for inputting data corresponding to game scores of game players;

timer means;

at least two second manually actuatable input switch means for stopping and starting said timer means to input timing data corresponding to the durations of the playing times of each of said game players;

third manually actuatable input switch means for inputting first, second and third game control signals; and data processing means comprising means responsive to said first game control signal for determining said winning player from said game score data only; means responsive to said second game control signal for determining said winning player from said timing data only; and means responsive to said third game control signal for determining said winning player form both of said game score data and said timing data.

2. A game score computing device as claimed in claim 1, further comprising game score display means for displaying said game scores of each of said game players and timing display means responsive to said timing data for displaying the duration of play by each of said game players; said data processing means including means for operating said game score display means and said timing display means in response to said game score data and said timing data respectively.

3. A game score computing device as claimed in claim 1, wherein said third game control signal responsive means comprise means for assigning a numerical value to said timing data of each of said players and combining said numerical value with said game score data of the respective player.

* * * * *